US008967122B2

(12) United States Patent
Miyata et al.

(10) Patent No.: US 8,967,122 B2
(45) Date of Patent: Mar. 3, 2015

(54) FUEL EVAPORATIVE EMISSION CONTROL DEVICE

(71) Applicant: Mitsubishi Jidosha Kogyo Kabushiki Kaisha, Tokyo (JP)

(72) Inventors: Toshiyuki Miyata, Okazaki (JP); Katsunori Ueda, Okazaki (JP); Hideto Ide, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 304 days.

(21) Appl. No.: 13/724,167

(22) Filed: Dec. 21, 2012

(65) Prior Publication Data

US 2013/0174812 A1 Jul. 11, 2013

(30) Foreign Application Priority Data

Jan. 5, 2012 (JP) ..... 2012-000632

(51) Int. Cl.
*F02M 33/02* (2006.01)
*F02M 25/08* (2006.01)

(52) U.S. Cl.
CPC ..... *F02M 25/08* (2013.01); *F02M 2025/0845* (2013.01)
USPC ..... 123/520; 123/518; 123/519; 123/521

(58) Field of Classification Search
CPC ..... F02M 25/0836
USPC ..... 123/518–521; 137/587
See application file for complete search history.

(56) References Cited

U.S. PATENT DOCUMENTS 3,886,920 A * 6/1975 Van Dusen et al. ..... 123/519
5,245,973 A * 9/1993 Otsuka et al. ..... 123/518
5,975,062 A * 11/1999 Bonse et al. ..... 123/519

FOREIGN PATENT DOCUMENTS

JP 4110932 B2 7/2008

* cited by examiner

*Primary Examiner* — Lindsay Low
*Assistant Examiner* — Robert Werner
(74) *Attorney, Agent, or Firm* — Birch, Stewart, Kolasch & Birch, LLP

(57) ABSTRACT

When fuel tank internal pressure is at a first predetermined pressure P1 or above over a first predetermined time length t1, a fuel tank shutoff valve is opened and a vapor solenoid valve is closed to make piping internal pressure equal to the fuel tank internal pressure. Then, a purge control valve is opened to emit fuel evaporative gas from the fuel tank into an intake passage. When the fuel tank internal pressure is continuously at a second predetermined pressure P2 or below over the first predetermined time length t1, the fuel tank shutoff valve is closed, and when accumulated volume in high-pressure purge finishing phase reaches a second predetermined volume iv2 or above, the vapor solenoid valve is opened. When the accumulated volume in high-pressure purge finishing phase reaches a first predetermined volume iv1 or above, the purge control valve is opened and the engine is stopped.

3 Claims, 4 Drawing Sheets

FUEL EVAPORATIVE EMISSION CONTROL DEVICE

BACKGROUND OF THE INVENTION

1. Field of the Invention

The present invention relates to a fuel evaporative emission control device, specifically control of operation of the fuel evaporative emission control device.

2. Description of the Related Art

In a prior-art technique to prevent fuel evaporative gas, produced within a fuel tank, from being emitted to the atmosphere, a fuel tank shutoff valve (sealing valve) is fitted to a passage connecting a fuel tank to a canister to seal the fuel tank, and at the time of filling the fuel tank, the sealing valve is opened to allow fuel evaporative gas to flow from the fuel tank into the canister and become adsorbed within the canister.

When the fuel tank is sealed by the sealing valve as in the aforementioned system, an increase in ambient air temperature may lead to a high pressure in the fuel tank because of more fuel evaporating within the fuel tank, which may lead to fuel evaporative gas being emitted to the atmosphere at the time of filling the fuel tank.

To prevent fuel evaporative gas from being emitted to the atmosphere at the time of filling the fuel tank, the sealing valve is opened upon detecting filling operations, and opening the fuel tank is inhibited until the pressure in the fuel tank decreases to a sufficiently low level.

However, it takes long for the pressure in the fuel tank to decrease to a desired level, and thus, it takes long before filling can be started.

To cope with this problem, a technique has been developed in which when the pressure in the fuel tank increases, if the engine is running and purge is being conducted, the sealing valve is opened to emit high-pressure fuel evaporative gas from the fuel tank into the intake passage of the engine, without letting them be adsorbed in the canister, thereby reducing the pressure in the fuel tank (JP 4110932 B2).

In the fuel evaporative gas management device in the aforementioned publication, if the pressure in the fuel tank increases to a high level while the engine is running, the sealing valve is opened and high-pressure fuel evaporative gas are directed from the fuel tank to the intake passage, and when the engine stops, the sealing valve is closed and purge is stopped. The manipulations of the sealing valve and the purge actions are thus synchronized.

When the manipulations of the sealing valve and the purge actions are synchronized, and thus, the purge is stopped at the same time that the sealing valve is closed, it follows that highly-concentrated fuel evaporative gas remain in the passage between the sealing valve and a purge control valve provided for control of purge.

If the engine is started and purge is resumed in this situation, the highly-concentrated fuel evaporative gas remaining in the passage is emitted into the intake passage. This is undesirable because it causes variations in air-fuel ratio of the intake air-fuel mixture drawn into the engine, which lead to variations in engine output and worse emissions.

SUMMARY OF THE INVENTION

An object of the present invention is to provide a fuel evaporative emission control device capable of suppressing variations in air-fuel ratio of the mixture drawn into the internal combustion engine, caused by fuel evaporative gas.

To achieve the above object, the present invention provides a fuel evaporative emission control device, comprising a connecting passage connecting an intake passage of an internal combustion engine and a fuel tank, a canister for adsorbing fuel evaporative gas incoming through the connecting passage, a connecting passage opening/closing unit switchable between an open and a closed positions to allow or block flow from the connecting passage to the intake passage, a canister opening/closing unit switchable between an open and a closed positions to allow or block flow between the canister and the connecting passage, and a tank opening/closing unit switchable between an open and a closed positions to allow or block flow from the fuel tank to the connecting passage, wherein the fuel evaporative emission control device conducts conducting connecting-passage purge to purge the connecting passage by putting the connecting passage opening/closing unit in the open position, the canister opening/closing unit in the closed position and the tank opening/closing unit in the closed position, conducts canister purge to purge the canister by putting the connecting passage opening/closing unit in the open position, the canister opening/closing unit in the open position and the tank opening/closing unit in the closed position, and conducts fuel-tank purge to purge the fuel tank by putting the connecting passage opening/closing unit in the open position, the canister opening/closing unit in the closed position and the tank opening/closing unit in the open position, wherein after finishing the fuel-tank purge, the evaporative emission control device conducts the connecting-passage purge for a first predetermined time and then conducts the canister purge for a second predetermined time.

As stated above, after the fuel-tank purge is finished, the connecting-passage purge is conducted for the first predetermined time and then the canister purge is conducted for the second predetermined time.

In the fuel-tank purge, fuel evaporative gas is emitted from the fuel tank into the intake passage of the internal combustion engine via the connecting passage. At the time that the fuel-tank purge is finished, fuel evaporative gas not reaching the intake passage but remaining in the connecting passage may form a pressure higher than the atmospheric pressure. Thus, by conducting the connecting-passage purge for the first predetermined time, fuel evaporative gas remaining in the connecting passage is emitted into the intake passage, preliminarily, to stabilize the pressure in the connecting passage at the atmospheric pressure. After the pressure in the connecting passage is reduced to the atmospheric pressure, the canister purge is conducted for the second predetermined time so that not only fuel evaporative gas remaining in the connecting passage but also fuel evaporative gas present in the canister in the form of being adsorbed on an adsorbent can be emitted into the intake passage.

Fuel evaporative gas is thus prevented from remaining in the connecting passage and the canister. As a result, in the next purging of the canister, emission of highly-concentrated fuel evaporative gas into the intake passage is prevented, and thus, abrupt change in air-fuel ratio of the mixture drawn into the internal combustion engine is prevented.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Figure 1:
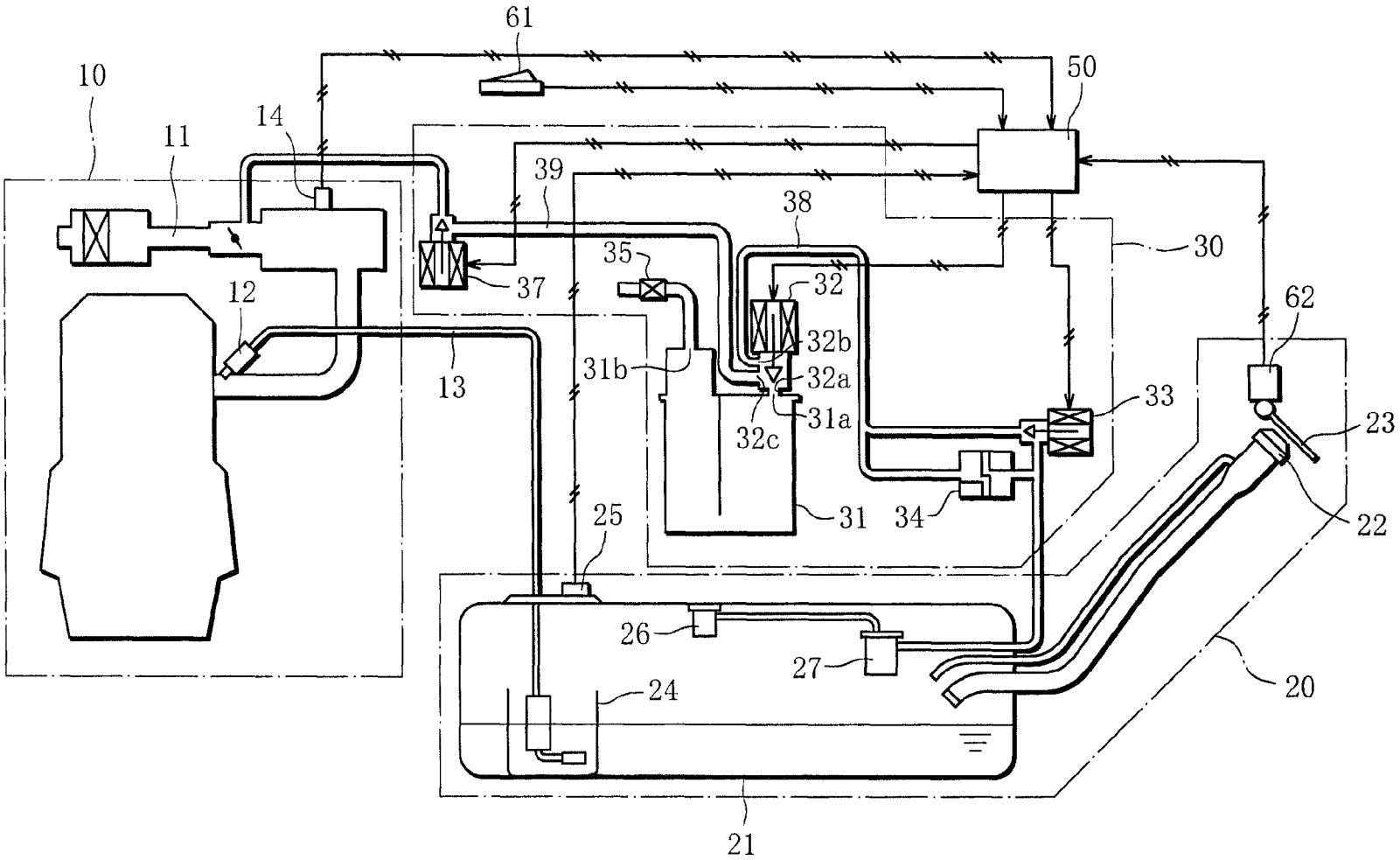
FIG. 1 is a diagram schematically showing the configuration of a fuel evaporative emission control device according to the present invention.

Referring to the drawings attached, a fuel evaporative emission control device according to the present invention will be described below.

FIG. 1 is a diagram schematically showing the configuration of a fuel evaporative emission control device according to the present invention. Now the configuration of the fuel evaporative emission control device according to the present invention will be described.

As seen in FIG. 1, the fuel evaporative emission control device according to the present invention, which performs general control of the vehicle by controlling, roughly speaking, an engine (internal combustions engine) 10, a fuel storage unit 20 for holding fuel and a fuel evaporative gas management unit 30 for managing fuel evaporative gas produced in the fuel storage unit 20, all mounted on the vehicle, comprises an electronic control unit (hereinafter referred to as "ECU") 50 including an input-output device, memory (including ROM, RAM and non-volatile RAM), a central processing unit (CPU) and others, a fuel filler lid opening/closing switch 61 for opening and closing a fuel filler lid 23 of the vehicle, and a fuel filler lid sensor 62 for detecting position of the fuel filler lid 23.

The engine 10 is a multi-point injection (MPI) four-cycle inline four-cylinder gasoline engine. The engine 10 has an intake passage 11 through which air is drawn into combustion chambers of the engine 10. An intake pressure sensor 14 is fitted to the intake passage 11 to detect internal pressure in the intake passage 11. Downstream of the intake passage 11, fuel injection valves 12 are provided to inject fuel to intake ports of the engine 10. The fuel injection valves 12 are connected to fuel piping 13, through which fuel is sent to them.

The fuel storage unit 20 comprises a fuel tank 21 to hold fuel, a fuel filler opening 22 through which fuel is put into the fuel tank 21, a fuel filler lid 23 fitted to the vehicle body to close the fuel filler opening 22, a fuel pump 24 to send fuel from the fuel tank 21 to the fuel injection valves 12 through the fuel piping 13, a pressure sensor 25 for detecting pressure in the fuel tank 21, a fuel cut-off valve 26 for preventing fuel from flowing from the fuel tank 21 to the fuel evaporative gas management unit 30 by action of a float valve incorporated therein, not shown, and a leveling valve 27 to control liquid surface in the fuel tank 21 when filling the fuel tank. Fuel evaporative gas, produced within the fuel tank 21, is emitted from the fuel tank 21 via the fuel cut-off valve 26 and the leveling valve 27.

The fuel evaporative gas management unit 30 comprises a canister 31, a vapor solenoid valve (canister opening/closing unit) 32, a fuel tank shutoff valve (tank opening/closing unit) 33, a safety valve 34, an air filter 35, a purge control valve (connecting passage opening/closing unit) 37, vapor piping (connecting passage) 38, and purge piping (connecting passage) 39.

The canister 31 holds activated carbon inside. The canister 31 has a vapor port 31*a* through which fuel evaporative gas from the fuel tank 21 can flow in and fuel evaporative gas, adsorbed on the activated carbon, can flow out. The canister 31 also has an ambient air inlet 31*b* to draw in ambient air to cause fuel evaporative gas to be released from the activated carbon and emitted from the canister 31. Upstream of the ambient air inlet 31*b*, an air filter 35 is arranged with its contaminants-entry prevention side directed to the atmosphere and the opposite side directed to the ambient air inlet 31*b*.

The vapor solenoid valve 32 has a canister-connected port 32*a* connected to the vapor port 31*a* of the canister 31. The vapor solenoid valve 32 further has a vapor piping-connected port 32*b* connected to the vapor piping 38, and a purge piping-connected port 32*c* connected to the purge piping 39. The vapor piping 38 is connected to the leveling valve 27 of the fuel tank 21, and the purge piping 39 is connected to the intake passage 11 of the engine 10. The vapor solenoid valve 32 is a normally-closed solenoid valve which is closed while a solenoid is not activated, and open while the solenoid is activated externally by drive signal. While the solenoid is activated externally by drive signal, the vapor solenoid valve 32 in the open position keeps the canister-connected port 32*a*, the vapor piping-connected port 32*b* and the purge piping-connected port 32*c* open, so that fuel evaporative gas can flow in and out the canister 31, and ambient air, drawn in through the air filter 35, can flow in the vapor piping 32 and the purge piping 39. While the solenoid is not activated, the vapor solenoid valve 32 in the closed position keeps only the vapor piping-connected port 32*b* and the purge piping-connected port 32*c* open, and blocks the canister-connected port 32*a*, thereby inhibiting fuel evaporative gas from flowing in and out the canister 31 and inhibiting ambient air from flowing in the vapor piping 38 and purge piping 39 via the air filter 35. In other words, while in the closed position, the vapor solenoid valve 32 seals the canister 31, and while in the open position, it keeps the canister 31 open.

The fuel tank shutoff valve 33 is fitted to the vapor piping 38. The fuel tank shutoff valve 33 is a normally-closed solenoid valve which is closed while a solenoid is not activated, and open while the solenoid is activated externally by drive signal. While the solenoid is not activated, the fuel tank shutoff valve 33 in the closed position blocks the vapor piping 38. While the solenoid is activated externally by drive signal, the fuel tank shutoff valve 33 in the open position allows flow in the vapor piping 38. In other words, while in the closed position, the fuel tank shutoff valve 33 seals the fuel tank 21 so that fuel evaporative gas, produced in the fuel tank 21, cannot flow out the fuel tank 21, and while in the open position, it allows fuel evaporative gas to flow from the fuel tank 21 to the canister 31.

The safety valve 34 is fitted to the vapor piping 38, in parallel with the fuel tank shutoff valve 33. The safety valve 34 opens when the pressure in the fuel tank 21 increases to a preset level or higher, thereby allowing fuel evaporative gas to flow to the canister 31 to prevent explosion of the fuel tank 21.

The purge control valve 37 is fitted to the purge piping 39, between the intake passage 11 of the engine 10 and the vapor solenoid valve 32. The purge control valve 37 is a normally-closed solenoid valve which is closed while a solenoid is not activated, and open while the solenoid is activated externally by drive signal. While the solenoid is not activated, the purge control valve 37 in the closed position blocks the purge piping 39. While the solenoid is activated externally by drive signal, the purge control valve 37 in the open position allows flow in the purge piping 39. In other words, while in the closed position, the purge control valve 37 inhibits fuel evaporative gas from flowing from the fuel evaporative gas management unit 30 to the engine 10, and while in the open position, it allows fuel evaporative gas to flow from the fuel evaporative gas management unit 30 to the engine 10.

The ECU 50 is a control unit performing general control of the vehicle, and comprises an input-output device, memory (including ROM, RAM and non-volatile RAM), a central processing unit (CPU), a timer and others.

To the input of the ECU 50 are connected the intake pressure sensor 14, the pressure sensor 25, the fuel filler lid opening/closing switch 61 for opening and closing the fuel filler lid 23 fitted to the vehicle, and the fuel filler lid sensor 62 for detecting position of the fuel filler lid 23. The ECU 50 thus receives information from these sensors.

To the output of the ECU 50 are connected the fuel injection valves 12, the fuel pump 24, the vapor solenoid valve 32, the fuel tank shutoff valve 33 and the purge control valve 37.

On the basis of information from the sensors, the ECU 50 controls operation of the vapor solenoid valve 32, the fuel tank shutoff valve 33 and the purge control valve 37; pressure in the fuel tank 21, pressure in the vapor piping 38 and purge piping 39 between the fuel tank shutoff valve 33 and the purge control valve 37; and flow of fuel evaporative gas, including adsorption within the canister 31 and emission from the canister 31 into the intake passage 11 of the engine 10.

Next, high-pressure purge control performed by the ECU 50 of the present invention described above to cause fuel evaporative gas to flow from the fuel tank 21 to the intake passage 11 of the engine 10 when internal pressure in the fuel tank 21 reaches a high level, thereby reducing the internal pressure in the fuel tank 21 will be described.

Figure 2:
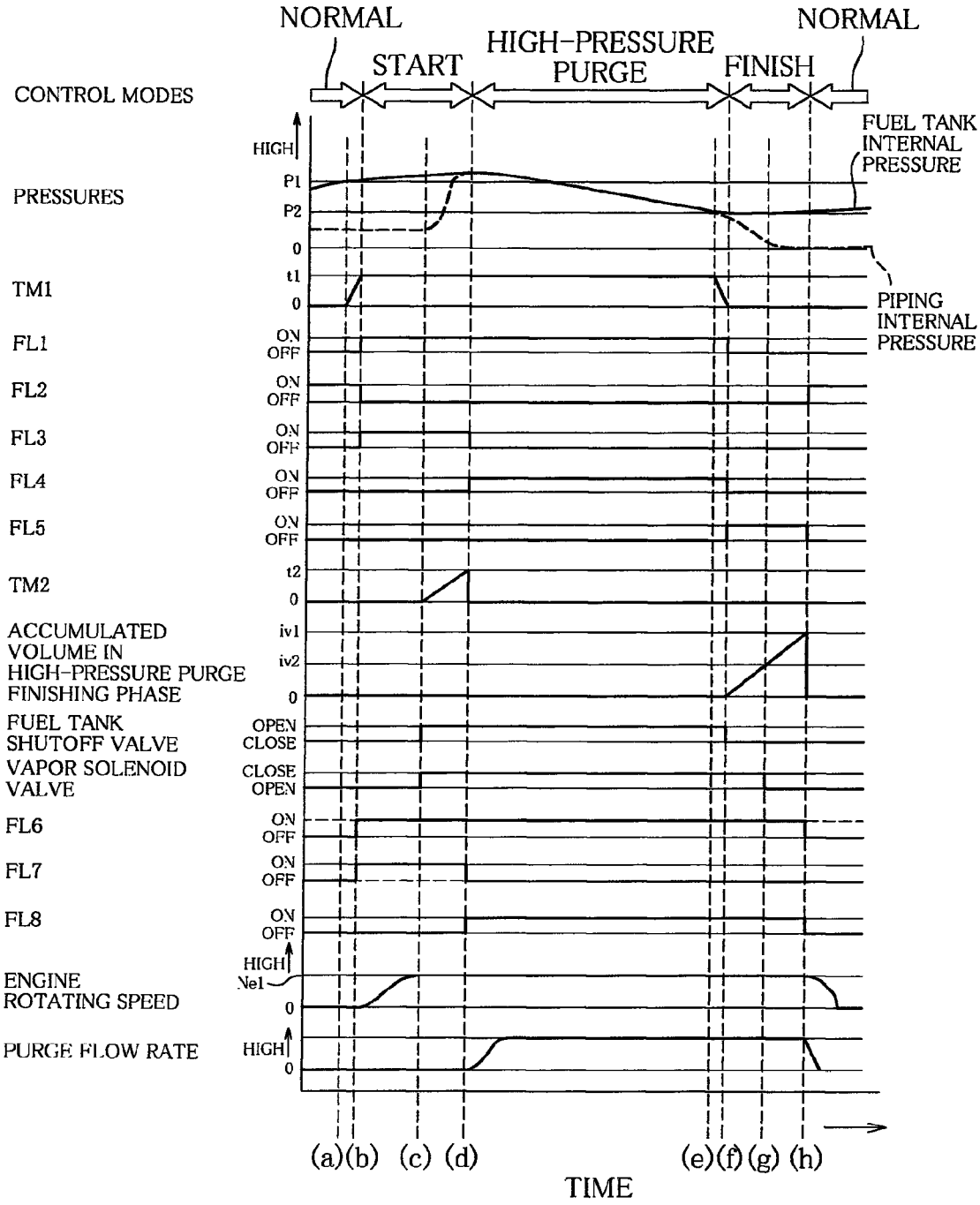
FIG. 2 is a diagram showing a sequence of high-pressure purge control actions of the fuel evaporative emission control device according to the present invention.

FIG. 2 shows the sequence of high-pressure purge control actions of the fuel evaporative emission control device according to the present invention. FIG. 2 shows, from the top downward, control modes, pressures, a high-pressure determination timer TM1, a fuel tank high-pressure flag FL1, a normal control flag FL2, a high-pressure purge start control flag FL3, a high-pressure control flag FL4, a high-pressure purge finish control flag FL5, a high-pressure start timer TM2, accumulated volume in high-pressure purge finishing phase, fuel tank shutoff valve 33 operating position, vapor solenoid valve 32 operating position, an engine operation demand flag FL6, a purge inhibition flag FL7, a purge control flag FL8, engine rotating speed, and purge flow rate. The control modes in FIG. 2 are modes of the high-pressure purge control. The pressures shown in FIG. 2 are fuel tank 21 internal pressure and piping internal pressure, or pressure in the vapor piping 38 and purge piping 39. P1 is a first predetermined pressure and P2 a second predetermined pressure. The purge inhibition flag FL7 in FIG. 2 indicates whether to activate the purge control valve 37. The purge inhibition flag FL7 being "ON" indicates that the purge control valve 37 should be closed, and its being "OFF" indicates that the purge control valve 37 should be open. Also the purge control flag FL8 in FIG. 2 indicates whether to activate the purge control valve 37. The purge control flag FL8 being "ON" indicates that the purge control valve 37 should be open, and its being "OFF" indicates that the purge control valve 37 should be closed. Between the purge inhibition flag FL7 and the purge control flag FL8, preference is given to the former. In FIG. 2, t1 indicates a first predetermined time length, t2 a second predetermined time length, iv1 a first predetermined volume, iv2 a second predetermined volume, and Ne1 a predetermined speed. FIGS. 3 to 7 are schematic diagrams showing what operating position each valve is in, at times (a) to (h) in FIG. 2, respectively.

As seen from FIG. 2, the high-pressure purge control, provided to reduce the internal pressure in the fuel tank 21 when it reaches a high level, is broadly divided into four modes: a normal control mode, a start control mode, a high-pressure purge control mode and a finish control mode. In the normal control mode, normal purge actions, including emission of fuel evaporative gas, adsorbed within the canister 31, from the canister 31 into the intake passage 11, are performed depending on the vehicle operating state. In the start control mode, the piping internal pressure, or internal pressure in the vapor piping 38 and purge piping 39 between the fuel tank 21 and the purge control valve 37 is regulated in order to perform high-pressure purge because of high internal pressure in the fuel tank 21. In the high-pressure purge control mode, the internal pressure in the fuel tank 21 is reduced by emitting fuel evaporative gas from the fuel tank 21 into the intake passage 11 via the vapor piping 38 and purge piping 39 (fuel-tank purge). In the finish control mode, fuel evaporative gas remaining in the vapor piping 38 and purge piping 39 between the fuel tank shutoff valve 33 and the purge control valve 37 are emitted into the intake passage 11 (connecting-passage purge), and in addition to this connecting passage purge, fuel evaporative gas present in the canister 31 in the form of being adsorbed on the activated carbon are emitted into the intake passage 11 (canister purge). Next, with reference to FIG. 2, control actions will be described in chronological order.

Figure 3:
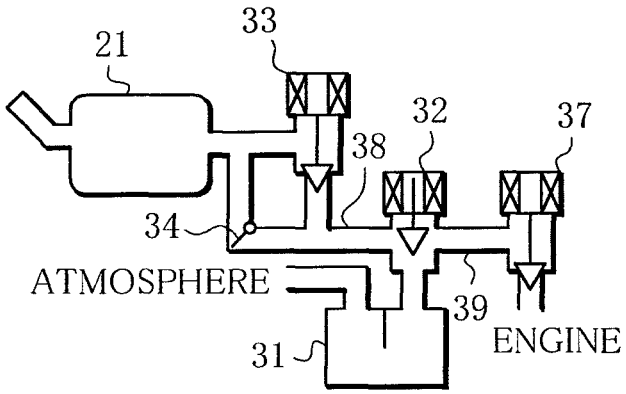
FIG. 3 is a diagram schematically showing operating positions of valves at times (a), (b) and (h) in FIG. 2.

As seen at time (a) in FIG. 2, normally the normal control flag FL2 is "ON" and normal purge actions are performed depending on the vehicle operating state. In the case of FIG. 2 given by way of example, at time (a), the engine 10 is at rest, the fuel tank shutoff valve 33 and the purge control valve 37 are closed, and the vapor solenoid valve 32 is open, as seen in FIG. 3. When the internal pressure in the fuel tank 21, detected by the pressure sensor 25, increases to the first predetermined pressure P1 or above as a result of more fuel evaporating within the fuel tank 21, the high-pressure determination timer TM1 is started to count up. If the internal pressure in the fuel tank 21 decreases below the first predetermined pressure P1, the high-pressure determination timer TM1 is reset to "0".

If the internal pressure in the fuel tank 21 is continuously at or above the first predetermined pressure P1 so that the value in the high-pressure determination timer TM1 reaches the first predetermined time length t1 as seen at time (b) in FIG. 2, it is determined that the internal pressure in the fuel tank 21 is high, and the fuel tank high-pressure flag FL1 is set to "ON". In addition, the normal control flag FL2 is set to "OFF" and the high-pressure purge start control flag FL3 is set to "ON", and the high-pressure purge control enters the start control mode. In the start control mode, first, the engine operation demand flag FL6 is set to "ON" and the engine 10 is started if it is at rest, and at the same time, the purge inhibition flag FL7 is set to "ON" and the purge control valve 37 is closed if it is open.

Figure 4:
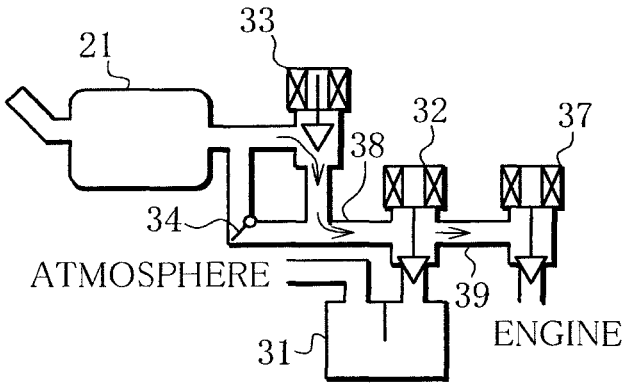
FIG. 4 is a diagram schematically showing operating positions of valves at time (c) in FIG. 2.

Then, when the engine rotating speed increases to the predetermined speed Ne1 or above as seen at time (c) in FIG. 2, the fuel tank shutoff valve 33 is opened, and at the same time, the vapor solenoid valve 32 is closed, as seen in FIG. 4. As a result, high-pressure fuel evaporative gas is emitted from the fuel tank 21 into the vapor piping 38 and purge piping 39 and spread up to the purge control valve 37. At the same time, the high-pressure start timer TM2 is started to count up. The vapor solenoid valve 32 is closed so that the fuel evaporative gas emitted will not become adsorbed on the activated carbon in the canister 31.

Figure 5:
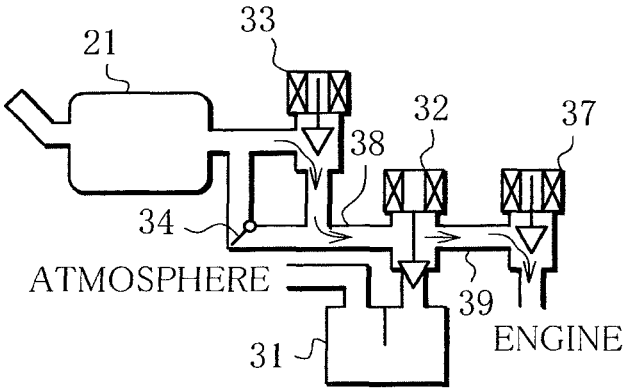
FIG. 5 is a diagram schematically showing operating positions of valves at times (d) and (e) in FIG. 2.

When the value in the high-pressure start timer TM2 reaches the second predetermined time length t2 or above as seen at time (d) in FIG. 2, the high-pressure purge start control flag FL3 is set to "OFF", the high-pressure control flag FL4 is set to "ON", and the high-pressure purge control enters the high-pressure purge control mode. In the high-pressure purge control mode, the purge inhibition flag FL7 is set to "OFF", the purge control flag FL8 is set to "ON", and the purge control valve 37 is opened to allow flow from the fuel tank 21 to the intake passage 11 as seen in FIG. 5. As a result, high-pressure fuel evaporative gas is emitted from the fuel tank 21 into the intake passage 11. The second predetermined time length t2 is the time taken for the vapor piping 38 and purge piping 39 between the fuel tank shutoff valve 33 and the purge control valve 37 to reach the same internal pressure as the fuel tank 21, which is obtained in advance experimentally or otherwise. Thus, now that the piping internal pressure, or internal pressure in the vapor piping 38 and purge piping 39 is equal to the internal pressure in the fuel tank 21, the purge flow rate, or flow rate of fuel evaporative gas emitted into the intake passage 11 is calculated from the internal pressure in the fuel tank 21, detected by the pressure sensor 25, the pressure in the intake passage 11, detected by the intake pressure sensor 14, and how much the purge control valve 37 is open.

Then, when the internal pressure in the fuel tank 21 decreases to the second predetermined pressure P2 or below as a result of emitting fuel evaporative gas from the fuel tank 21 into the intake passage 11, as seen at time (e) in FIG. 2, the high-pressure determination timer TM1 is started to count down from the first predetermined time length t1.

Figure 6:
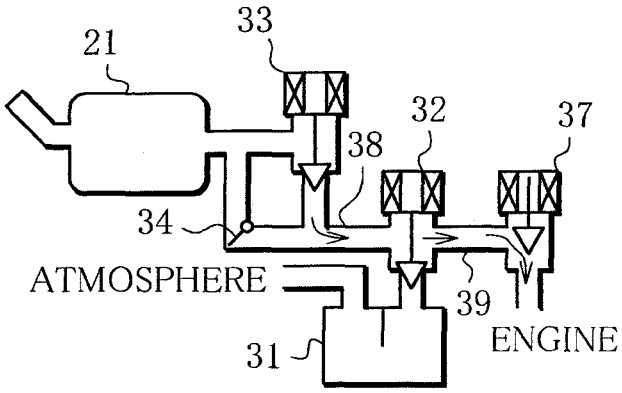
FIG. 6 is a diagram schematically showing operating positions of valves at time (f) in FIG. 2.

Then, as seen at time (f) in FIG. 2, when the value in the high-pressure determination timer TM1 reaches "0" while the internal pressure in the fuel tank 21 is continuously at or below the second predetermined pressure P2, it is determined that the internal pressure in the fuel tank 21 has decreased, and the fuel tank high-pressure flag FL1 is set to "OFF". In addition, the high-pressure control flag FL4 is set to "OFF", the high-pressure purge finish control flag FL5 is set to "ON", and the high-pressure purge control enters the finish control mode. In the finish control mode, first, the fuel tank shutoff valve 33 is closed as seen in FIG. 6, and calculation of accumulated volume in high-pressure purge finishing phase, or accumulated volume of fuel evaporative gas, or air containing gaseous fuel purged via the vapor piping 38 and purge piping 39 after the fuel tank shutoff valve 33 is closed is started.

The way of calculating the accumulated volume in high-pressure purge finishing phase is as follows: at the time that the high-pressure purge control enters the finish control mode, the internal pressure P(n) in the vapor piping 38 and purge piping 39 is equal to the internal pressure in the fuel tank 21. The purge flow rate ΔQ is calculated at regular intervals from the internal pressure P(n) in the vapor piping 38 and purge piping 39, and the pressure in the intake passage 11, detected by the intake sensor 14. The accumulated volume in high-pressure purge finishing phase is calculated from the purge flow rate ΔQ calculated this way. More specifically, the volume ΔV of air purged, or drawn from the vapor piping 38 and purge piping 39 into the intake passage 11 during time ΔT is calculated from the purge flow rate ΔQ (the initial purge flow rate is calculated from the internal pressure P in the vapor piping 38 and purge piping 39 and the pressure in the intake passage 11, detected by the intake pressure sensor 14) and time ΔT by expression (1) below:

$$\Delta V=\Delta Q\times\Delta T \tag{1}$$

The volume V(n) of air in the vapor piping 38 and purge piping 39 after time ΔT of purging is calculated from the volume V(n−1) of air in the vapor piping 38 and purge piping 39 calculated last time (the initial volume of air in the vapor piping 38 and purge piping 39 is the inner volume V of the vapor piping 38 and purge piping 39) and the volume ΔV of air purged during time ΔT, by expression (2) below:

$$V(n)=V(n-1)-\Delta V \tag{2}$$

The internal pressure P(n) in the vapor piping 38 and purge piping 39 after time ΔT of purging is calculated from the internal pressure P in the vapor piping 38 and purge piping 39 at the time that the high-pressure purge control enters the finish control mode, the inner volume V of the vapor piping 38 and purge piping 39, and the volume of air V(n) in the vapor piping 38 and purge piping 39 after time ΔT of purging, by expression (3) below:

$$P(n)=P\times V/V(n) \tag{3}$$

The accumulated volume in high-pressure purge finishing phase is calculated by summing the volumes ΔV of air purged during each interval.

Figure 7:
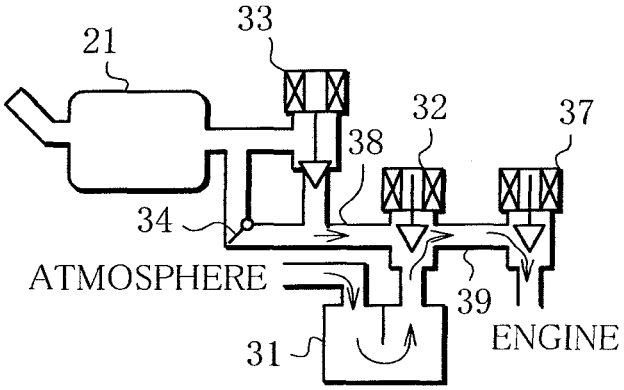
FIG. 7 is a diagram schematically showing operating positions of valves at time (g) in FIG. 2.

Then, when the accumulated volume in high-pressure purge finishing phase reaches the second predetermined volume iv2 or above as seen at time (g) in FIG. 2 (the time between time (f) and time (g) in FIG. 2 is the "first predetermined time" in claims), the vapor solenoid valve 32 is opened as seen in FIG. 7. The second predetermined volume iv2 is registered as the time taken for the internal pressure in the vapor piping 38 and purge piping 39 between the fuel tank shutoff valve 33 and the purge control valve 37 to decrease to the atmospheric pressure. The relation between approximate accumulated volume and time taken for the internal pressure in the vapor piping 38 and purge piping 39 to decrease to the atmospheric pressure is obtained in advance experimentally or otherwise, and stored in the form of a map in the ECU 50. The time taken for the internal pressure in the vapor piping 38 and purge piping 39 to decrease to the atmospheric pressure in each situation is obtained from the map depending on the purge flow rate calculated from the internal pressure P(n) in the vapor piping 38 and purge piping 39 and the pressure in the intake passage 11, detected by the intake pressure sensor 14.

Then, when the accumulated volume in high-pressure purge finishing phase reaches the first predetermined volume iv1 or above as seen at time (h) in FIG. 2 (the time between time (g) and time (h) in FIG. 2 is the "second predetermined time" in claims), the high-pressure purge finish control flag FL5 is set to "OFF", the normal control flag FL2 is set to "ON" and the high-pressure purge control returns to the normal control mode. In the normal control mode, the purge control flag FL8 is set to "OFF" and the purge control valve 37 is closed as seen in FIG. 3. In addition, the engine operation demand flag FL6 is set to "OFF" and the engine 10 is stopped. The first predetermined volume iv1 is at least the inner volume of the vapor piping 38 and purge piping 39 added to the second predetermined volume iv2. The first predetermined volume iv1 may be the inner volume of the canister 31 further added to the above two volumes.

As stated above, in the fuel evaporative emission control device according to the present invention, if the internal pressure in the fuel tank 21 increases to a high level, specifically the first predetermined pressure P1 or above (time (a) in FIG. 2) and is continuously at such high level over the first predetermined time length t1, the high-pressure purge control enters the start control mode, so that the engine 10 is started and the purge control valve 37 is closed (time (b) in FIG. 2). Then, when the rotating speed of the engine 10 reaches the predetermined speed Net, the fuel tank shutoff valve 33 is opened and the vapor solenoid valve 32 is closed, and at the same time, the high-pressure start timer TM2 is started to count up (time (c) in FIG. 2). Then, when the value in the high-pressure start timer TM2 reaches the second predetermined time length t2, the high-pressure purge control enters the high-pressure purge control mode, so that the purge control valve 37 is opened (time (d) in FIG. 2). The second predetermined time length t2 is the time taken for the vapor piping 38 and purge piping 39 between the fuel tank shutoff valve 33 and the purge control valve 37 to reach the same internal pressure as the fuel tank 21, which is obtained in advance experimentally or otherwise. Then, when the internal pressure in the fuel tank 21 decreases to the second predetermined pressure P2 or below, the high-pressure determination timer TM1 is started to count down from the first predetermined time length t1 (time (e) in FIG. 2). Then, when the value in the high-pressure determination timer TM1 reaches "0", the high-pressure purge control enters the finish control mode, so that the fuel tank shutoff valve 33 is closed, and calculation of accumulated volume in high-pressure purge finishing phase, or accumulated volume of fuel evaporative gas purged after the fuel tank shutoff valve 33 is closed is started (time (f) in FIG. 2). Then, when the accumulated volume in high-pressure purge finishing phase reaches the second predetermined volume iv2 or above, the vapor solenoid valve 32 is opened (time (g) in FIG. 2). The second predetermined volume iv2 is the volume to be purged for the internal pressure in the vapor piping 38 and purge piping 39 between the fuel tank shutoff valve 33 and the purge control valve 37 to decrease to the atmospheric pressure (101.3 kPa). Then, when the accumulated volume in high-pressure purge finishing phase reaches the first predetermined volume iv1 or above, the high-pressure purge control returns to the normal control mode, so that the purge control valve 37 is closed and the engine 10 is stopped. The first predetermined volume iv1 is at least the inner volume of the vapor piping 38 and purge piping 39 up to the purge control valve 37 added to the second predetermined volume iv2.

In the high-pressure purge control mode, fuel evaporative gas is emitted from the fuel tank 21 into the intake passage 11 of the engine 10 via the vapor piping 38 and purge piping 39. If the fuel tank shutoff valve 33 and the purge control valve 37 are closed immediately after the high-pressure purge control mode, it may result in the piping internal pressure being higher than the atmospheric pressure, because of fuel evaporative gas not reaching the intake passage 10 of the engine 10 but remaining in the vapor piping 38 and purge piping 39 between the fuel tank shutoff valve 33 and the purge control valve 37.

Thus, after the high-pressure purge control mode, the purge control valve 37 is kept open until the accumulated volume of fuel evaporative gas passing through the purge control valve 37 reaches the second predetermined volume iv2. Then, with the purge control valve 37 kept open, the vapor solenoid valve 32 is opened. The purge control valve 37 and the vapor solenoid valve 32 are kept open until the accumulated volume of fuel evaporative gas passing through the purge control valve 37 reaches the first predetermined volume iv1. The second predetermined volume iv2 is the volume to be purged for the pressure in the vapor piping 38 and purge piping 39 between the fuel tank shutoff valve 33 and the purge control valve 37 to decrease to the atmospheric pressure (101.3 kPa), and the first predetermined volume iv1 is at least the inner volume of the vapor piping 38 and purge piping up to the purge control valve 37 added to the second predetermined volume iv2. By manipulating the purge control valve 37 and the vapor solenoid valve 32 in this manner, it is ensured that not only fuel evaporative gas remaining in the vapor piping 38 and purge piping 39 between the fuel tank shutoff valve 33 and the purge control valve 33 but also fuel evaporative gas present in the canister 31 in the form of being adsorbed on the activated carbon are emitted into the intake passage 11. As a result, in the next purging of the canister 31, emission of highly-concentrated fuel evaporative gas from the canister 31 into the intake passage 11 is prevented, and thus, abrupt change in air-fuel ratio of the mixture drawn into the engine 10 is prevented.

By preliminary keeping the purge control valve 37 open until the accumulated volume of fuel evaporative gas passing through the purge control valve 37 reaches the second predetermined volume iv2, the internal pressure in the vapor piping 38 and purge piping 39 between the fuel tank shutoff valve 33 and the purge control valve 37 decreases to the atmospheric pressure.

Then, with the purge control valve 37 kept open, the vapor solenoid valve 32 is opened. This ensures that in addition to fuel evaporative gas remaining in the vapor piping 38 and purge piping 39 between the fuel tank shutoff valve 33 and the purge control valve 37, fuel evaporative gas existing in the canister 31 in the form of being adsorbed on the activated carbon are emitted into the intake passage 11 of the engine 10.

Although in the above-described embodiment, the tank sealing valve 33 is opened at the same as the vapor solenoid valve 32 is closed, it may be arranged such that first the vapor solenoid valve 32 is closed and thereafter the tank sealing valve 33 is opened.

What is claimed is:

1. A fuel evaporative emission control device, comprising:

a connecting passage connecting an intake passage of an internal combustion engine and a fuel tank, a canister for adsorbing fuel evaporative gas incoming through the connecting passage, a connecting passage opening/closing unit switchable between an open and a closed positions to allow or block flow from the connecting passage to the intake passage, a canister opening/closing unit switchable between an open and a closed positions to allow or block flow between the canister and the connecting passage, and a tank opening/closing unit switchable between an open and a closed positions to allow or block flow from the fuel tank to the connecting passage, wherein the fuel evaporative emission control device conducts conducting connecting-passage purge to purge the connecting passage by putting the connecting passage opening/closing unit in the open position, the canister opening/closing unit in the closed position and the tank opening/closing unit in the closed position, conducts canister purge to purge the canister by putting the connecting passage opening/closing unit in the open position, the canister opening/closing unit in the open position and the tank opening/closing unit in the closed position, and conducts fuel-tank purge to purge the fuel tank by putting the connecting passage opening/closing unit in the open position, the canister opening/closing unit in the closed position and the tank opening/closing unit in the open position, wherein after finishing the fuel-tank purge, the evaporative emission control device conducts the connecting-passage purge for a first predetermined time and then conducts the canister purge for a second predetermined time.

2. The fuel evaporative emission control device according claim 1, wherein the second predetermined time is at least the time taken for the total volume purged through the connecting passage to become equal to the inner volume of the connecting passage.

3. The fuel evaporative emission control device according claim 1, wherein the first predetermined time is the time taken for the pressure in the connecting passage to decrease to atmospheric pressure.

* * * * *